United States Patent [19]

Maures et al.

[11] Patent Number: 4,826,637

[45] Date of Patent: May 2, 1989

[54] PROCESS FOR THE MANUFACTURE OF COMBUSTIBLE ARTICLES BY PRESSING COMBUSTIBLE PAPER DISCS BY MEANS OF A FLEXIBLE PUNCH

[75] Inventors: Michel Maures; Thierry Bonnabaud, both of Bergerac; Francois Gendreau, Velines, all of France

[73] Assignee: Societe Nationale des Poudres et Explosifs, Paris, France

[21] Appl. No.: 24,313

[22] Filed: Mar. 10, 1987

Related U.S. Application Data

[63] Continuation-in-part of Ser. No. 776,430, Sep. 16, 1985, Pat. No. 4,705,655.

[30] Foreign Application Priority Data

Mar. 21, 1986 [FR] France ..... 86 04039

[51] Int. Cl.[4] ..... C06B 21/00; F42B 5/18; D03D 23/00; D03D 43/00

[52] U.S. Cl. ..... 264/3.4; 86/1.1; 86/20.1; 100/208; 100/211; 102/431; 102/432; 102/700; 149/2; 149/94; 149/96; 149/109.6; 162/226; 264/3.1; 264/293

[58] Field of Search ..... 86/10, 11, 20.1; 102/464, 465, 466, 467, 431, 432, 700; 162/150, 226; 149/109.6, 94, 96, 98, 100, 2; 100/92, 93 R, 93 P, 143, 292, 208, 211, 258 A, 264, 295, 296, 915; 264/293, 3.1, 3, 4; 101/3 R; 493/299; 53/461, 465; 425/403, 412, 398

[56] References Cited

U.S. PATENT DOCUMENTS

| | | | |
|---|---|---|---|
| 3,977,325 | 8/1976 | Jacobsen et al. | 86/1.1 |
| 4,068,589 | 1/1978 | Oversohl | 149/96 |
| 4,178,207 | 12/1979 | Oversohl | 162/384 |
| 4,649,827 | 3/1987 | Brasquies et al. | 102/431 |
| 4,705,655 | 11/1987 | Maures et al. | 86/1.1 |
| 4,724,017 | 2/1988 | Eich et al. | 149/11 |

FOREIGN PATENT DOCUMENTS

| | | |
|---|---|---|
| 1540454 | 9/1968 | France . |
| 2014647 | 7/1969 | France . |
| 2038557 | 1/1971 | France . |
| 2234113 | 7/1973 | France . |
| 2462262 | 7/1979 | France . |
| 2461567 | 2/1981 | France . |
| 2404566 | 11/1981 | France . |
| 2485182 | 12/1981 | France . |

*Primary Examiner*—Howard J. Locker
*Attorney, Agent, or Firm*—Bucknam and Archer

[57] ABSTRACT

The invention relates to the field of combustible ammunition and relates chiefly to the manufacture of bottoms or covers for combustible cases.

According to the invention, a combustible article is manufactured by pressing in a die 10 at least one sheet 21 of combustible paper containing nitrocellulose and having the shape of a disc, by virtue of a rigid movable punch 20 exerting a compressive force on a deformable flexible punch 22 arranged inside the said die 10 between the sheets 21 and the said movable punch 20. The flexible punch 22 is in the shape of a substantially cylindrical thick disc, consists of neoprene or a silicone resin and has a hardness of between 55 and 65 Shore at 20° C. The pressing operation is accompanied by a thermoforming operation carried out at approximately 115° C.

The process is particularly suitable for the production of bottoms of combustible cases bearing studs or grooves on their side faces.

14 Claims, 4 Drawing Sheets

PROCESS FOR THE MANUFACTURE OF COMBUSTIBLE ARTICLES BY PRESSING COMBUSTIBLE PAPER DISCS BY MEANS OF A FLEXIBLE PUNCH

This application is a continuation-in-part of U.S. Ser. No. 776,430 filed Sept. 16, 1985, which has issued on Nov. 10, 1987 as U.S. Pat. No. 4,705,655.

The present invention relates essentially to the field of combustible ammunition and in particular to that of combustible artillery ammunition.

More precisely, the invention relates to a process for the manufacture, from combustible paper containing nitrocellulose, of dish-shaped combustible articles with circular external outlines, by pressing combustible paper discs in a mould by means of a flexible punch such as a rubber punch. The process according to the invention is suitable, in particular, for the manufacture of bottoms or of covers for combustible cases.

In the field of artillery in particular, the armaments industry has been attempting to replace the traditional ammunition in which the cases are made of copper or of a copper-based alloy by what is known as combustible ammunition, in which the cases consist of a combustible material which burns at the same time as the propellent powder charge, thereby contributing additional energy to the projectile and eliminating the problems connected with the extraction of an empty metal case after firing.

Within the scope of the present invention, the term "case" should be taken within a broad meaning referring both to a single cylindrical or conical case to the end of which the shell is attached, and a modular, generally cylindrical, container, intended to be placed in the weapon independently of the shell to form a component of the propellent charge which is determined as a function of the nature of the firing to be performed.

A major technical problem confronting the specialist is that of large-scale manufacture of such combustible cases. In point of fact, just like the traditional metal cases, a combustible case consists essentially of, on the one hand, a cylindrical or conical case body and, on the other hand, closing members such as bottoms or covers, which are generally dish-shaped components with circular external outlines. Repetitive manufacture of combustible case bodies has been solved by spiral winding of glue-coated strips of combustible paper, the said combustible paper being itself produced by passing through a papermaking machine an aqueous suspension containing nitrocellulose fibres, fibres of organic, synthetic, plant or mineral origin, a resin and, if desired, a stabilizer such as 2-nitrodiphenylamine or a centralite. French Patent Application No. 2,485,182 and French Patent Application No. 2,555,302, which corresponds to U.S. Pat. No. 4,649,827, in the name of the applicant, describe a manufacturing process of this kind in detail. On the other hand, so far, the large-scale manufacture of the closing members for such combustible cases has not yet been solved in a fully satisfactory manner.

These closing members are generally dish-shaped articles with circular external outlines. They must have two essential characteristics, namely, on one hand they must have good mechanical behaviour and, on the other hand, they must be perfectly combustible so as to burn completely at the same time as the powder charge without leaving incandescent residues or ash. Good combustibility of articles of this type is ensured by the presence of nitrocellulose in their constituent material. The use of combustible paper containing nitrocellulose has not so far made it possible to obtain such articles in a satisfactory manner, the term "paper" denoting, within the scope of the present invention, any material obtained by a papermaking method, be it, properly speaking, a paper within the conventional meaning of the term, or a board, as a function of its weight per unit surface area. In point of fact, while methods for producing boxes or receptacles by folding sheets of paper, such as those described, for example, in French Patent No. 2,404,566, are known, on one hand these methods make it possible to produce only articles with rectangular rather than circular outlines and, on the other hand, they do not make it possible to produce articles which have sufficient mechanical strength to be capable of being employed as ammunition components. Furthermore, when attempts are made to manufacture articles with circular outlines by pressing solid discs of combustible paper, paper folds and superpositions are produced in the regions where the article is raised, as shown by French Patent No. 2,038,557, which relates to the manufacture of paper filters, giving rise to the appearance of regions of high density in the article, and these cannot burn correctly even when they consist of paper containing nitrocellulose. To overcome difficulties of this kind, French Patent No. 2,461,567 proposes to manufacture articles of revolution with circular outlines by pressing two paper sheets, between which there is arranged a layer of readily deformable soft material. However, this method has two major disadvantages: on one hand, it does not solve the problems connected with the requirement of a combustible nature of the article insofar as this question is not tackled in the patent and, on the other hand, it is relatively complex in its implementation, which is not readily applicable to large-scale manufacture.

The question is further complicated in the case where the article with circular outlines is not one of revolution but one which has protuberances or cavities over its side walls, as is frequently the case, for example, with the bottoms of combustible cases which have stop abutments or fastening grooves.

The manufacture of such outlines using purely mechanical tools is highly complex and very costly. It is known to produce such profiles in metallurgy by pressing a flat metal sheet in a die having the required profile by means of a deformable flexible punch consisting, in general, of a rubbery material or even of a fluid, itself compressed by a rigid circular punch. The flexible punch behaves as a pseudo-fluid which tries to occupy all the available space and distorts the sheet metal to the internal shapes of the mould, thus making it possible to produce an article whose side surfaces carry protuberances or cavities. This method is described, for example, in French Pat. No. 2,462,262 and French Pat. No. 2,549,749 which corresponds to U.S. Pat. No. 4,562,717 and also in French Patent No. 2,014,647 which describes the use of this method to manufacture components for metal cases. Nevertheless, the single-step manufacture of dish-shaped objects which have protuberances or cavities on the side wall, by pressing a flat sheet in a mould by means of a flexible punch, has so far been employed only for metal articles.

From French Pat. No. 1,540,454 and French Pat. No. 2,430,476, which corresponds to U.S. Pat. No. 4,221,556, it is known to shape strips of cellulosic material by means of tools whose surfaces are covered with rubbery material such as, for example, neoprene, but, properly speaking, these methods do not consist of compression in a mould by means of a deformable flexible punch and apply only to cellulosic materials which do not contain nitrocellulose and which do not present the same risks of ignition by heating due to the friction on insulating substances such as rubbery materials.

In order to manufacture closure members for combustible cases which have both good mechanical strength characteristics and good combustion characteristics, the specialist was therefore hitherto obliged to make use of moulding techniques, according to which the components ar manufactured by pressing and curing in a mould an aqueous suspension whose composition is similar to that employed for producing combustible paper containing nitrocellulose, using a process similar to that described in French Pat. No. 2,234,113 in the name of the applicant company. While this solution is satisfactory insofar as the quality of the products obtained is concerned, it nevertheless has the major disadvantage of requiring the use of a large number of stationary moulds and, as a result, not permitting low-cost, large-scale manufacture.

At the present time the specialist does not have available a simple and low-cost process for the large-scale manufacture of dish-shaped combustible articles with circular external outlines and particularly of combustible closure components for combustible cases or for members of combustible cases.

The object of the present invention is to provide the specialist with such a process.

The present invention consequently relates to a process for the manufacture of dish-shaped combustible articles with circular external outlines, and particularly of components for combustible cases, or combustible containers such as covers or bottoms by pressing in a die at least one sheet of combustible paper containing nitrocellulose in the shape of a disc by means of a rigid movable punch, characterized in that the said rigid movable punch is caused to exert a compressive force on a deformable flexible punch arranged inside the die between the sheets of combustible paper and the rigid movable punch.

According to a preferred embodiment of the invention, the deformable flexible punch consists of a block of a rubber chosen from the group consisting of neoprene polymers and of silicone polymers whose hardness at 20° C. is between 55 and 65 Shore.

According to another preferred embodiment of the invention, the die consists of two identical or different splits.

When the internal side faces of the splits are provided with protuberances or with cavities, the process according to the invention makes it possible to obtain in a single compression, starting with plane sheets of combustible paper containing nitrocellulose, dish-shaped combustible articles with circular outlines whose side surfaces may incorporate relief zones such as, for example, studs or grooves.

The process according to the invention is thus particularly suitable for producing bottoms of combustible cases incorporating fastening or end-stop studs or grooves on their side faces.

A detailed description of the invention is given below, with reference to FIGS. 1 to 9.

Figure 1:
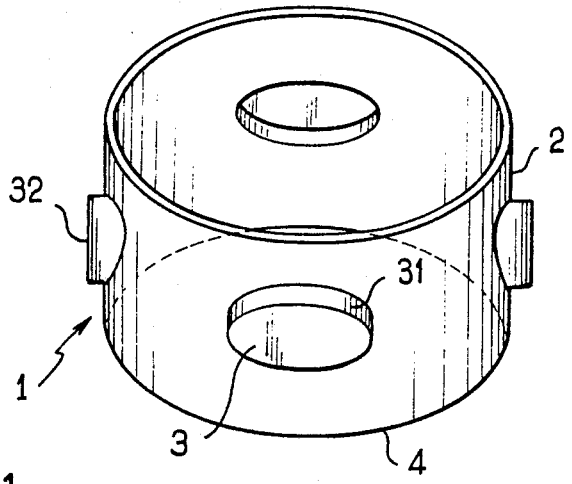
FIG. 1 shows a combustible article which may be obtained by virtue of the process according to the invention.

As has already been stated, the invention relates to a process for the manufacture of dish-shaped combustible articles 1 with circular external outlines such as, in particular, covers or bottoms for combustible cases or for combustible containers. An article of this kind is shown, for example, in FIG. 1.

The article 1 has the overall shape of a cylindrical box consisting of a cylindrical side wall 2 and a circular flat bottom 4. One of the essential advantages of the invention is to make it possible to produce combustible articles incorporating relief zones such as, for example, studs or grooves, on their side face. The article 1 shown in FIG. 1 thus incorporates four studs 3 arranged at regular intervals halfway up its side surface 2. Each stud 3 has a side surface 31, which consists of a right cylinder whose cross-section through a plane at right angles to the bottom 4 is an elipse and it is closed outwardly by a plane surface 32 lying in a plane at right angles to the said bottom 4.

An article of this kind is manufactured according to the invention by pressing, in a single stage, sheets of combustible paper containing nitrocellulose, said sheets being disc-shaped.

The discs used for the manufacture of the combustible articles according to the invention are produced by cutting out sheets of combustible paper containing nitrocellulose. The manufacture of the sheets is performed by starting with an aqueous suspension containing nitrocellulose, fibres of organic, synthetic, plant or mineral origin, a resin, a stabilizer such as diphenylamine, if desired, and fillers such as talc, tungstic anhydride or titanium oxide. As nitrocellulose, there may be used any industrial nitrocellulose having a nitrogen content of less than 13.8%, so long as the nitrogen content of the paper leaving the papermaking machine does not exceed 12%. According to a preferred embodiment of the invention, the nitrocellulose content used would be such that the content of nitrogen in the paper leaving the papermaking machine lies close to 9%. As fibres of organic origin, there will advantageously be used cellulose fibres such as kraft fibres, but other natural or regenerated cellulose fibres may also be equally suitable, including mechanical or semichemical pulp fibres or viscose fibres. Polyester fibres or acrylic fibres will advantageously be used as fibres of synthetic origin. Sisal fibres will advantageously be used as fibres of plant origin and glass fibres will advantageously be used as fibres of mineral origin.

The presence of a resin is essential in order to improve the cohesion of the fibres with each other and the stability of the paper sheet. Any organic resin which has the property of flocculating on nitrocellulose or cellulose fibres and which withstands passage through a papermaking machine can be used. The preferred resins are acrylic resins, vinyl resins, butadiene-based latices such as butadiene-styrene or butadiene-acrylonitrile latices. It has been noted that the weight quantity of resin must represent at least 2% of the weight quantity of nitrocellulose and of the fibres employed and that it should preferably lie close to 5%. The weight ratios of nitrocellulose in relation to other fibres may vary between 80:10 and 10:80 and preferably between 70:20 and 20:70. As for the concentration of solids in the aqueous suspension, this depends essentially on the papermaking machine employed, on the standard conditions of use recommended by the manufacturer and on the specifications of the required product.

After leaving the papermaking machine, the sheet produced may be calendered hot or cold, or not be calendered. According to a preferred embodiment of the invention, at least the sheets from which the discs intended to form the outer layer of the article will be cut out will be calendered.

The operation of pressing sheets of combustible paper into the form of discs is carried out in a die 10 by means of a rigid punch 20 and a deformable flexible punch 22. In the case where the combustible article to be produced is merely an article of revolution whose side surface does not incorporate any relief zone, the die 10 may consist of a single part. On the other hand, in the case where the combustible article 1 to be manufactured has a side surface incorporating relief zones, it is important that the die 10 should consist of at least two identical or different parts which can be disassembled from each other in order to permit the demoulding of the article after pressing.

Figure 2:
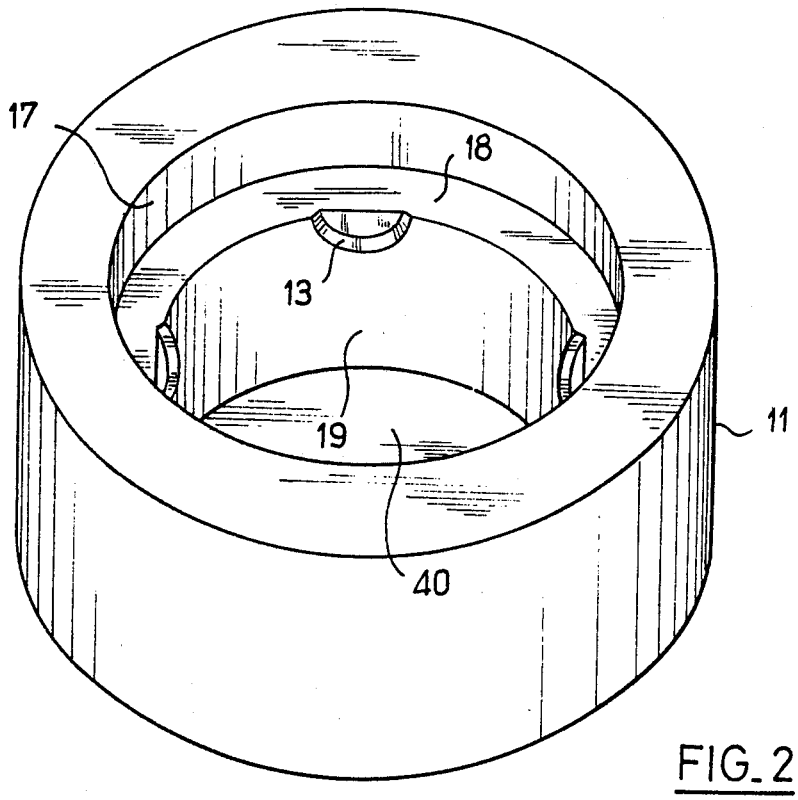
FIG. 2 shows a split which can be used within the scope of the invention.
Figure 4:
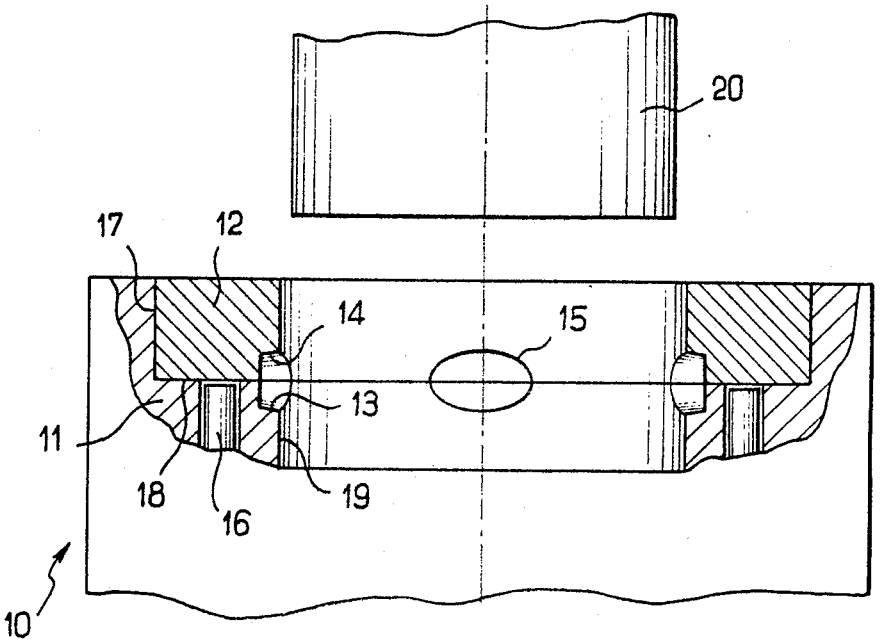
FIG. 4 shows a sectional view of the complete die shown in FIG. 2.

FIG. 4 shows a die 10 of this kind, consisting of two splits whose contact plane is horizontal. The die 10 thus consists of an annular split 11, shown in perspective in FIG. 2, in which an annular split 12 can be positioned, the whole being made complete by a rigid movable plunger 20.

The split 11 consists of a metal cylinder closed by a bottom 40 and hollowed out so as to have, starting from the said bottom 40, an inner side wall 19, itself defining a cylinder whose diameter is equal to the external diameter D1 of the side face 2 of the article 1 and whose height is equal to half the height of the side face 2. The inner side wall 19 is extended by an annular flat 18 and by an inner side wall 17, itself defining a cylinder whose diameter D2 is greater than the diameter D1 of the side face 2. The annular split 12 has an external diameter equal to the diameter D2 defined by the inner side wall 17 of the split 11 and an internal diameter equal to the diameter D1 defined by the inner side wall 19 of the split 11. The annular split 12 is thus supported against tee inner side face 17 and against the flat 18 of the split 11. The split 11 incorporates four cavities 13, each corresponding to half the volume of a stud 3, while the annular split 12 itself incorporates four cavities 14, each corresponding to half the volume of a stud 3. The annular split 12 should be placed in the split 11 so as to make the cavities 13 coincide with he cavities 14. This produces a die 10 incorporating four cavities 15 whose value corresponds to that of a stud 3. Two ejector pins 16 emerging on the flat 18 are housed in the body of the split 11 so as to enable the annular split 12 to be withdrawn, as explained hereinafter.

Figure 3:
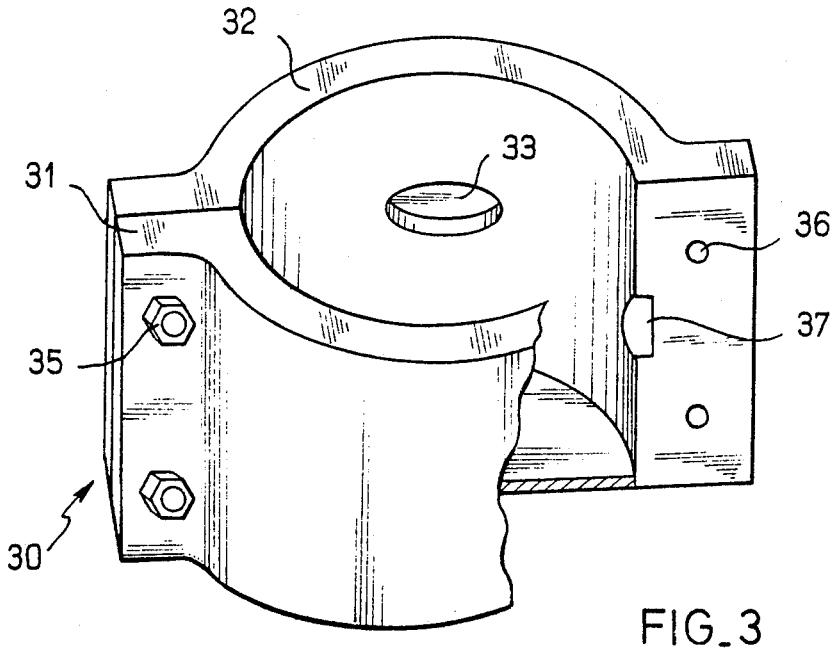
FIG. 3 shows another type of die which can be used within the scope of the invention.

FIG. 3 shows another embodiment of a die 30 according to the invention, which consists of two identical splits 31 and 32 assembled together by means of screws 35 which can be placed in the holes 36 provided at the periphery of the bodies 31 and 32 which, once assembled, define a hollow cylinder closed at the bottom. Each split incorporates a cavity 33 situated completely outside the contact plane and whose volume corresponds to that of the stud 3, and of two cavities 37 opening out onto the contact plane and whose volume corresponds to half the volume of a stud 3.

Figure 8:
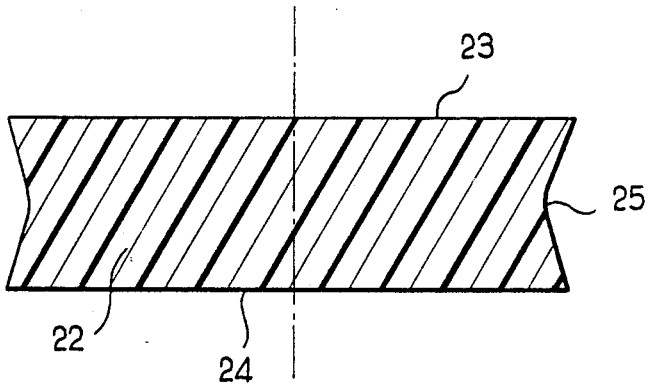
FIG. 8 shows a deformable flexible punch according to the invention.

The implementation of the invention also requires the use of a deformable flexible punch 22. A punch of this kind, shown in FIG. 8, has, at rest, the shape of a block having the appearance of a thick, substantially cylindrical disc whose diameter is very slightly smaller than the internal diameter of the article 1 to be produced and whose height is substantially equal to the depth of the hollow part of the die 10. According to a preferred embodiment of the invention, the diameter of the punch 22 is not uniform in all planes, but the median diameter 25 is slightly smaller than the diameter of the outer plane faces 22, 23 so as to give the block a slightly waisted appearance, as shown in FIG. 8.

According to another preferred embodiment of the invention, the deformable flexible punch 22 consists of a block of hard rubber which withstands a temperature of 130° C. and whose hardness at 20° C. is between 55 and 65 Shore. The preferred rubbers within the scope of the present invention are neoprene polymers and silicone polymers. The actual manufacture of a combustible article is carried out as described below, with more particular reference to FIGS. 5, 6 and 7 concerning the way the process is carried out.

Figure 9:
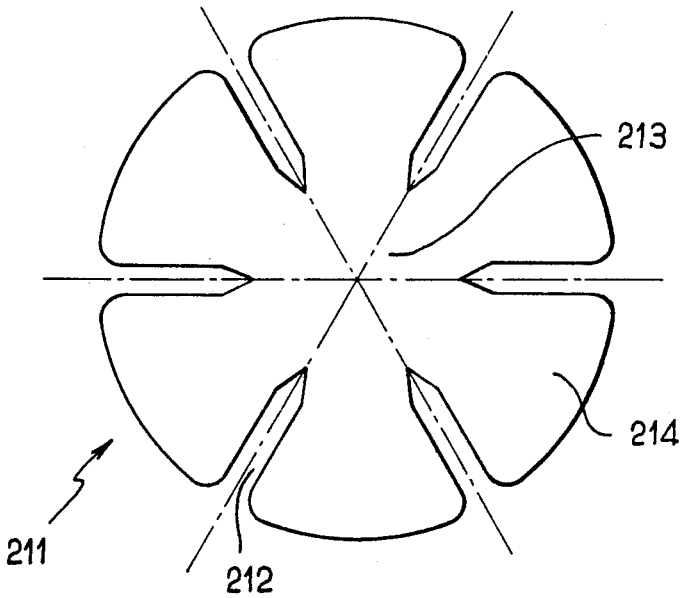
FIG. 9 shows a disc of combustible paper containing nitrocellulose which can be used within the scope of the present invention.

A combustible article such as shown, for example, in FIG. 1 is produced directly by a single pressing of at least one disc-shaped sheet of combustible paper. A combustible paper disc 211 of this kind is shown in FIG. 9 and consists preferably, of a solid middle section 213, corresponding to the flat bottom 4 of the article to be produced, and a peripheral section consisting of a plurality of sections 214 which are separated from each other by radial slots 212, this peripheral section corresponding to the side surface 2 of the article to be produced, the slots 212 making it possible to avoid the presence of excess substance in this side surface 2.

The number of slots provided on the combustible paper disc is not critical. However, the lower value and the upper value of this number is constrained by two factors. An inadequate number of slots necessarily implies large peripheral sections and the risk that, in the course of the deformation by pressing, there will appear therein regions of paper folding and of superposition which will correspond in the finished article to regions of poor combustion. On the other hand, an excessive number of slots may give rise to problems connected with an excessive fragility of the disc when blanks are cut. The number of slots is therefore a function of the diameter and of the outline of the article to be produced. In the case of articles intended to form closure components for conventional artillery ammunition, a number of slots of between 6 and 16 is generally reasonable.

According to a preferred embodiment of the invention, furthermore, the slots 212 are identical.

According to a preferred embodiment of the invention, the combustible article is produced by pressing a number of discs of combustible paper containing nitrocellulose, substantially of the same diameter, which are superposed on each other so that, before pressing, the radial slots of each disc are not superposed on each other but are, on the contrary, offset relative to each other, according to the method described in French Patent Application No. 84/14,587, which corresponds to U.S. Pat. No. 4,705,655, the description of which is incorporated, by reference, in the present description insofar as the discs of combustible paper are concerned.

The number of discs of combustible paper which are superposed on each other depends on the physicochemical nature of the combustible paper employed and on the required characteristics of the finished article. In general, a number of discs of about 6 will be preferred.

The various discs which are superposed on each other before pressing may advantageously be coated with adhesive on one of their faces. The adhesives employed will be vinyl or acrylic adhesives in aqueous emulsion or "hot-melt" adhesives based on ethyl and vinyl acetate (E.V.A.), on polyolefins or on polyamides or, yet again, adhesives containing a nitrocellulose-based solvent.

Figure 5:
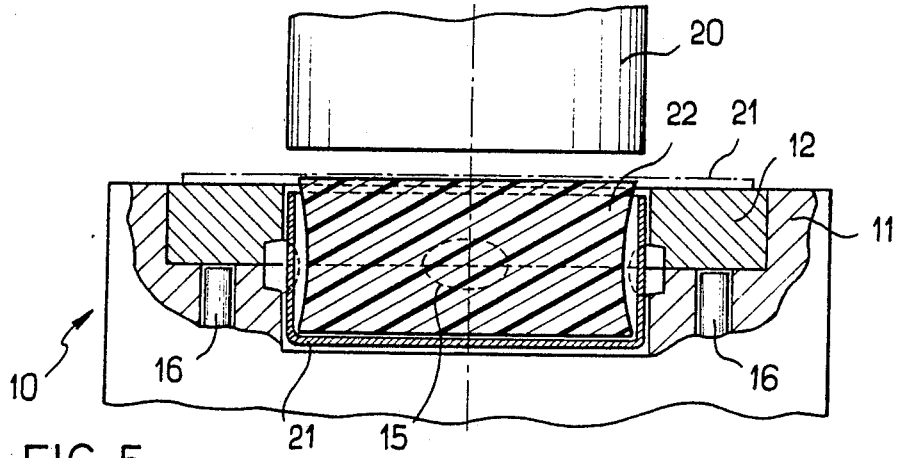
FIG. 5 shows the entry of the combustible paper and of the deformabale flexible punch into said die.
Figure 6:
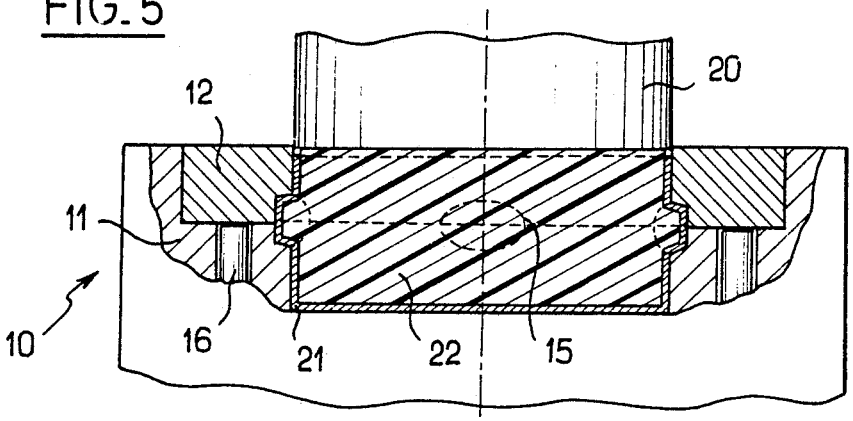
FIG. 6 shows the compression stage as such.

The sheets 21 of combustible paper which are prepared in this manner are arranged flat on the die 10 as shown by the thin line of dots and dashes in FIG. 5 and are then positioned inside the die 10 by the entry of the deformable flexible punch 22 by virtue of the movable punch 20. The rigid movable punch 20 is then lowered so as to compress the deformable flexible punch 22 which, as shown in FIG. 6, behaves as a pseudo-fluid, driven to occupy all the available space and which thus forces the sheets of combustible paper 21 to match accurately the internal outline of the die 10, especially the interior of the cavities 15. Furthermore, if the deformable flexible punch 22 is chosen from the group of materials listed above, it completely and at all points transmits the pressure exerted by the rigid movable punch 20, thus ensuring a completely homogeneous compression. The compressive pressure exerted by the deformable flexible punch 22 is generally in the region of $25\times10^5$ Pa.

According to a preferred embodiment of the invention, the pressing of the sheets of combustible paper is performed hot at a temperature below or equal to 125° C., and this makes it possible to cure the resin present in the combustible paper and thus definitively to fix the shape of the combustible article produced while, at the same time, in the case of combustible articles produced from several sheets of combustible paper, also making possible better adhesion between the various sheets by virtue of partial gelling of the various constituents of the combustible paper, which leads to the sheets being truly "welded" together. It is this latter phenomenon which explains that the presence of adhesive between the various sheets is preferred, but is not compulsory within the scope of the present invention.

According to a preferred embodiment of the invention, the pressing temperature is in the neighbourhood of 115° C. and the duration of the thermoforming operation is in the neighbourhood of one minute. For safety reasons, however, it is recommended not to exceed a temperature of 125° C.

Figure 7:
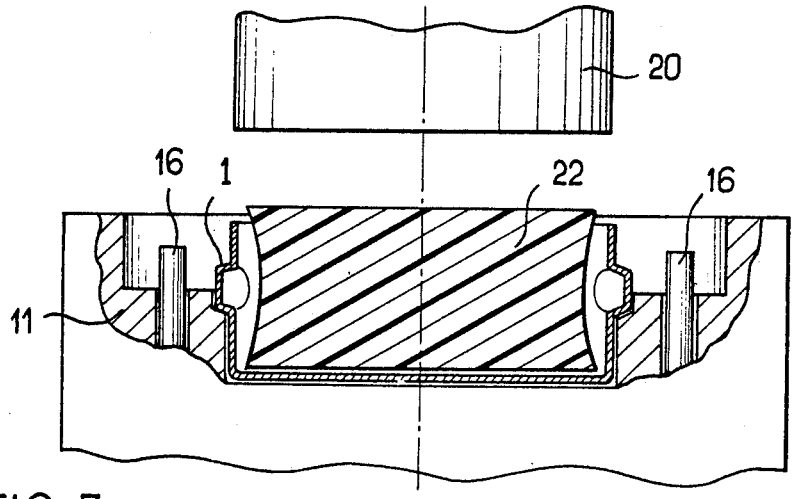
FIG. 7 shows the stage of demoulding after compression.

With the compression and thermoforming stage completed, it then remains to perform the demoulding of the combustible article 1 produced. With reference, by way of example, to FIG. 7, the movable plunger 20 is lifted again, the ejector pins 16 in the high position enable the annular split 12 to be withdrawn and it then remains to withdraw the deformable flexible punch 22 and the article 1.

The implementation of the process according to the invention in the case of a combustible article incorporating studs on its side face has thus been illustrated in all its aspects. In the case of an article incorporating reentrant zones such as, for example, grooves, on its side face, it is merely necessary to use a die 10 whose inner face incorporates not cavities but protuberances which correspond to the reentrant zones which are to be produced.

Thus, the process according to the invention makes it possible to produce, simply and rapidly and in a single stage, dish-shaped combustible articles with circular external outlines, capable of incorporating relief zones, such as, for example, studs or grooves, on their side surface, starting from plane sheets of combustible paper containing nitrocellulose.

The examples which follow illustrate certain potentialities of implementation of the invention without limiting its scope.

EXAMPLE 1

An article such as shown in FIG. 1 was manufactured by pressing and thermoforming 3 sheets of combustible paper.

The composition of the paper sheets was as follows:
nitrocellulose: 68 parts
cellulose: 16 parts
acrylic resin: 5 parts
(methyl and ethyl polyacrylate)
acrylic fibres: 10 parts
diphenylamine (stabilizer): 1 part The substance of the combustible paper was 980 g/m$^2$. The two inner sheets were not calendered and had a density of 0.4 (thickness: 2.45 mm). The outer sheet was calendered cold to a density of 0.7 (thickness 1.4 mm).

These sheets were used for cutting out 3 discs such as shown in FIG. 9, having the following geometric characteristics:

(1) Discs constituting the inner layers (geometry 1):
Disc radius: 115 mm
Number of slots: 16 identical slots in diametrically opposed pairs.
Slot dimensions:
Length: 42 mm
Width at the periphery of the disc: 16.5 mm.

(2) Disc constituting the outer layer (geometry 2):
Disc radius: 115 mm
Number of slots: 16 identical slots in diametrically opposed pairs.
Slot dimensions:
Length: 44.5 mm
Width at the periphery of the disc: 17.5 mm.

The three discs were superposed so that the slots of each disc were offset in relation to the slots in the other discs.

These discs were converted, as described earlier, at 110° C. for 1 minute under a pressure of $26\times10^5$ Pa.

The speed of downward travel of the movable punch was 245 mm/s.

A flexible neoprene punch with a hardness of 60 Shore at 20° C. whose outer faces had a diameter of 144 mm and which was 43 mm in height was employed.

In this manner, a combustible article similar to that shown in FIG. 1 was obtained, its flat bottom 4 having a diameter of 148 mm, its height being 50 mm and its thickness being 4 mm.

EXAMPLE 2

The method followed was that of Example 1, using 6 sheets of combustible paper having two different compositions.

Composition A:
Nitrocellulose: 70 parts
Cellulose: 24 parts
Acrylic resin: 5 parts
Diphenylamine: 1 part
Composition B:
Nitrocellulose: 60 parts
Cellulose: 22 parts
Acrylic resin: 8 parts
Diphenylamine: 1 part
Talc (filler): 9 parts.

4 sheets of composition A were used to form the inner layers of the combustible article and 2 sheets of composition B to form the outer layers of the article.

The substance of the various sheets was 450 g/m$^2$.

The density of the sheets of composition A was 0.4 (thickness: 0.89 mm) and that of the sheets of composition B was 0.7 (thickness: 0.64 mm).

The discs cut from the sheets of composition A had geometry 1 and those cut from the sheets of composition B geometry 2, as outlined in Example 1.

The conversion was performed in an identical manner to that in Example 1, except for the duration of the conversion operation, which was 90 seconds.

A combustible article whose thickness is 3.15 mm was produced in this manner.

We claim:

1. Process for the manufacture of a dish-shaped combustible article (1) with circular external outlines and with cavities or protuberances, and particularly components for combustible cases or combustible containers, such as covers or bottoms, which consists of placing in the interior of a die (10) at least one sheet (21) of combustible paper containing nitrocellulose prepared from an aqueous suspension containing nitrocellulose by a paper making method, in the shape of a disc, wherein said die (10) consists of at least two splits (11, 12) and the inner side faces of the said splits (11, 12) are provided with protuberances or cavities (13, 14), placing a deformable flexible punch (22) on top of said at least one sheet of paper, applying a compressive force on said deformable punch by means of a rigid movable punch (20).

2. The process according to claim 1 wherein two splits are provided.

3. The process according to claim 2 wherein said splits are identical.

4. The process according to claim 2 wherein said splits are different.

5. The process according to claim 1 wherein said deformable flexible punch (22) is in the shape of a circular disc having a median diameter and outer faces, said outer faces having a diameter, said median diameter (25) is smaller than the diameters of the outer faces (23, 24).

6. The process according to claim 1 wherein said deformable flexible punch (22) consists of a block of hard rubber which withstands 130° C.

7. The process according to claim 6 wherein said deformable flexible punch (22) consists of a block of rubber of hardness at 20° C. between 55 and 65 Shore.

8. The process according to claim 7 wherein said deformable flexible punch (22) is made of a rubber which is a member selected from the group consisting of neoprene polymers and silicone polymers.

9. The process according to claim 1 wherein said deformable flexible punch (22) is in the shape of a thick, substantially cylindrical disc.

10. The process according to claim 1 wherein said die (10) is heated to a temperature below or equal to 125° C.

11. The process according to claim 1 wherein the pressure exerted by said rigid movable punch (20) on said deformable flexible punch (22) is in the neighborhood of $25\times10^5$ Pa.

12. The process according to claim 1 wherein said nitrocelluolose has nitrogen content less than 13.8%, and the nitrogen content of the paper leaving the paper-making machine is about 9%.

13. The process according to claim 1 wherein said paper comprises kraft fibers, acrylic fibers and glass fibers and a resin capable of flocculating, said resin being a vinyl resin, an acrylic resin, butadiene styrene or butadiene acrylonitrile, said resin being in the amount of 2–5% of the weight of said fibers and said nitrocellulose.

14. The process according to claim 13 wherein the ratio of said nitrocellulose to said fibers in said paper is 80:10–10:80.

* * * * *